US005220959A

United States Patent [19]

Vance, Sr.

[11] Patent Number: 5,220,959

[45] Date of Patent: Jun. 22, 1993

[54] GRIPPING INFLATABLE PACKER

[75] Inventor: James C. Vance, Sr., Sedalia, Colo.

[73] Assignee: The Gates Rubber Company, Denver, Colo.

[21] Appl. No.: 764,653

[22] Filed: Sep. 24, 1991

[51] Int. Cl.[5] ..... E21B 33/127

[52] U.S. Cl. ..... 166/187; 166/122; 166/212; 277/34

[58] Field of Search ..... 166/187, 212, 122, 206; 138/93; 277/34, 34.6, 34.3; 411/71, 19, 457–468

[56] References Cited

U.S. PATENT DOCUMENTS

| | | | |
|---|---|---|---|
| 647,169 | 4/1900 | Vogel | 411/459 X |
| 1,776,500 | 9/1930 | Gilpin | 411/457 X |
| 2,652,894 | 9/1953 | Brown et al. | 166/206 X |
| 2,743,781 | 5/1956 | Lane | 166/212 |
| 2,970,651 | 2/1961 | Roberts | 166/212 |
| 3,035,639 | 5/1962 | Brown et al. | 166/187 X |
| 3,097,696 | 7/1963 | Orr | 166/122 X |
| 3,593,749 | 7/1971 | Reardon | 138/93 |
| 4,345,649 | 8/1982 | Baugh et al. | 166/120 |
| 4,422,477 | 12/1983 | Wittman et al. | 138/89 |
| 4,424,861 | 1/1984 | Carter, Jr. et al. | 166/120 |
| 4,441,561 | 4/1984 | Garmong | 166/387 |
| 4,457,369 | 7/1984 | Henderson | 166/125 |
| 4,497,368 | 2/1985 | Baugh | 166/208 |
| 4,524,825 | 6/1985 | Fore | 166/139 |
| 4,600,058 | 7/1986 | Van Wormer et al. | 166/382 |
| 4,614,346 | 9/1986 | Ito | 166/187 X |
| 4,627,491 | 12/1986 | Zunkel | 166/126 |
| 4,657,084 | 4/1987 | Evans | 166/387 |
| 4,697,640 | 10/1987 | Szarka | 166/120 |
| 4,711,326 | 10/1987 | Baugh et al. | 188/67 |
| 4,732,212 | 5/1988 | Fraser, III | 166/216 |
| 4,750,563 | 6/1988 | Baugh | 166/382 |
| 4,762,177 | 8/1988 | Smith, Jr. | 166/216 |

FOREIGN PATENT DOCUMENTS

| | | | |
|---|---|---|---|
| 702327 | 1/1965 | Canada . | |
| 2506425 | 11/1982 | France | 138/93 |
| 2124274 | 7/1982 | United Kingdom . | |
| 2124275 | 7/1982 | United Kingdom . | |

*Primary Examiner*—Hoang C. Dang

*Attorney, Agent, or Firm*—Steven G. Austin; John L. Isaac; H. W. Oberg

[57] ABSTRACT

A gripping inflatable packer having an elastomeric bladder expandable to sealingly engage the outer surface thereof against the wall surface of the well bore to effectively inhibit the passage of well fluid through the well bore. The gripping inflatable packer has an elastomeric bladder with an outer surface sized and shaped to provide a portion that is engageable with the wall bore wall surface, upon expansion thereof. The engageable surface portion has a middle band portion extending cylindrically around the outer surface, and first and second shoulder portions disposed on either side of the middle band portion. Each shoulder portion extends cylindrically around the outer surface. The gripping inflatable packer also has a mechanism for gripping the wall surface of the well bore upon expansion of its bladder. This gripping mechanism includes at least one gripper device attached to the outer surface of the elastomeric bladder. The gripper device has a base plate having first and second surfaces disposed on opposite sides of the plate and at least one projecting member terminating in a point protruding from the first surface, for engagement with the well surface upon inflation of the packer.

7 Claims, 5 Drawing Sheets

GRIPPING INFLATABLE PACKER

BACKGROUND OF THE INVENTION

1. Field of the Invention

This invention relates generally to downhole packers and, more particularly, to inflatable packers for sealing an annular space in a well bore. Specifically, the present invention relates to an improved gripping mechanism for maintaining such packers in position within the well bore.

2. Description of the Prior Art

An inflatable packer is a down hole tool which is inflatable with a fluid or with some other mechanism to seal off an annular space in a well bore. Such well bores are, at times, left unlined so that the well bore wall is the material bored into. At other times, the well bore is lined with a metal casing; and in such cases, the well bore wall is the casing. Although not so limited, the packer of the invention is particularly suited for isolating zones within a well for such purposes as cementing, fracturing, treating, testing, preventing gas migration to the surface, and for gravel pack operation.

Early prior art inflatable packers relied upon the inflation and resulting expansion of an elastomeric bladder to both seal off an annular space in the well bore as well as to provide frictional force to prevent axial displacement of the packer within the well bore while it is deployed. In such an arrangement, the amount of frictional force generated is limited to the frictional properties of the materials of the bladder and the well bore wall, multiplied by the force per unit area (or pressure density) supplied by the pressurized fluid within the bladder. A recognized problem with prior art packers has been the inability of the inflatable packers to engage the well bore wall surface with adequate frictional force to resist external forces placed upon the packer, which tend to displace the packer axially from its deployed position.

Attempts to solve this displacement problem, by increasing the frictional force, have included a variety of different mechanisms. One such attempt places woven or calendered steel cable around the outer surface of the bladder, so that the cable is pressed against the well bore wall surface when the bladder is inflated. This is disclosed in U.S. Pat. No. 4,424,861 to Carter, et al. Another arrangement includes placing multi-edged particles in two bands around the outer surface of the bladder that are located near the ends of the bladder and thereby leaving the middle region of the outer surface bare of such particles, so as to allow this middle region to provide the necessary sealing engagement. In still another arrangement, inverted cone grippers (where the annular edge of the cone's base is intended to engage the well bore wall surface) are placed around the outer surface in the same manner as the multi-edge particles discussed above. Another arrangement places serrated plates (where the edges of the serration are intended to engage the well bore wall surface) around the outer surface in a similar manner. Examples of these last three arrangements are illustrated in Canadian Patent No. 702,327 and U.S. Pat. No. 3,035,639, Brown et al. In still another prior art device disclosed in U.S. Pat. No. 2,970,651 to Roberts, overlapping steel bands, with spikes distributed over every second band, are placed covering the entire outer surface. All of these attempts at solving the problem of displacement of inflatable packers have been apparently inadequate by either not providing adequate frictional force or not providing an effective seal.

The gripping device of U.S. Pat. No. 4,424,861 apparently lacks the ability to adequately press the gripping surface into the well bore wall to cause embedment of the same and thus not creating the required frictional force. It has been discovered that this is because the geometry of the gripper device generates little or no multiplication of pressure density imparted from the bladder to the surface of the gripping device that contacts the well bore wall surface. Further, the rounded edgewise contact made with the wall by the gripping device is not conducive to creating adequate frictional force. The gripping device also interferes with the sealing engagement of the outer surface of the bladder. The gripping devices of Canadian Patent No. 702,327 also have inherently limited ability to multiply the pressure density, as they rely upon edgewise contact between the gripping devices and the well bore wall surface.

Further, it has been determined that by distributing the gripping devices and the devices of U.S. Pat. No. 4,424,861 near the ends of the bladder, the well fluid has the opportunity to apply a lifting force on the bladder immediately around the gripping devices, thereby reducing the pressure such devices apply to the well bore wall as well as allowing continuous lubrication of the engagement of the gripping device with the well bore wall surface. Both of these effects tend to reduce the frictional force generated by the gripping devices. Thus, there is still a need for inflatable packers which do not exhibit undesirable axial movement within the well bore when acted upon by normal operating well bore fluid forces.

SUMMARY OF THE INVENTION

Accordingly, the subject invention has as an object the provision of a packer construction which overcomes the problem of axial displacement under normal well bore fluid operating pressures.

Another object of the present invention is to provide an improved gripping mechanism for use with inflatable packer elements.

Still another object of the present invention is to provide a gripping mechanism for fluid inflatable packers which multiply the fluid pressure effect against the well bore walls to enhance gripping.

To achieve the foregoing and other objects and in accordance with a purpose of the present invention, as embodied and broadly described herein, a gripping inflatable packer device is disclosed herein. The device includes a gripping inflatable packer having an elastomeric bladder expandable to sealingly engage the outer surface thereof against the wall surface of the well bore to effectively inhibit the passage of well fluid through the well bore. The gripping inflatable packer has an elastomeric bladder with an outer surface sized and shaped to provide a portion that is engageable with the wall bore wall surface, upon expansion thereof. The engageable surface portion has a middle band portion extending cylindrically around the outer surface, and first and second shoulder portions disposed on either side of the middle band portion. Each shoulder portion extends cylindrically around the outer surface. The gripping inflatable packer also has a mechanism for gripping the wall surface of the well bore upon expansion of its bladder. This gripping mechanism includes at least one gripper device attached to the outer surface of the elastomeric bladder. The gripper device has a base plate having first and second surfaces disposed on opposite sides of the plate and at least one projecting member terminating in a point protruding from the first surface, for engagement with the well surface upon inflation of the packer.

BRIEF DESCRIPTION OF THE DRAWINGS

The accompanying drawings, which are incorporated in and form a part of the specification and in which like numerals designate like parts, illustrate preferred embodiments of the present invention and together with a description, serve to explain the principles of the invention. In the drawings.

DETAILED DESCRIPTION OF THE PREFERRED EMBODIMENTS

Figure 1:
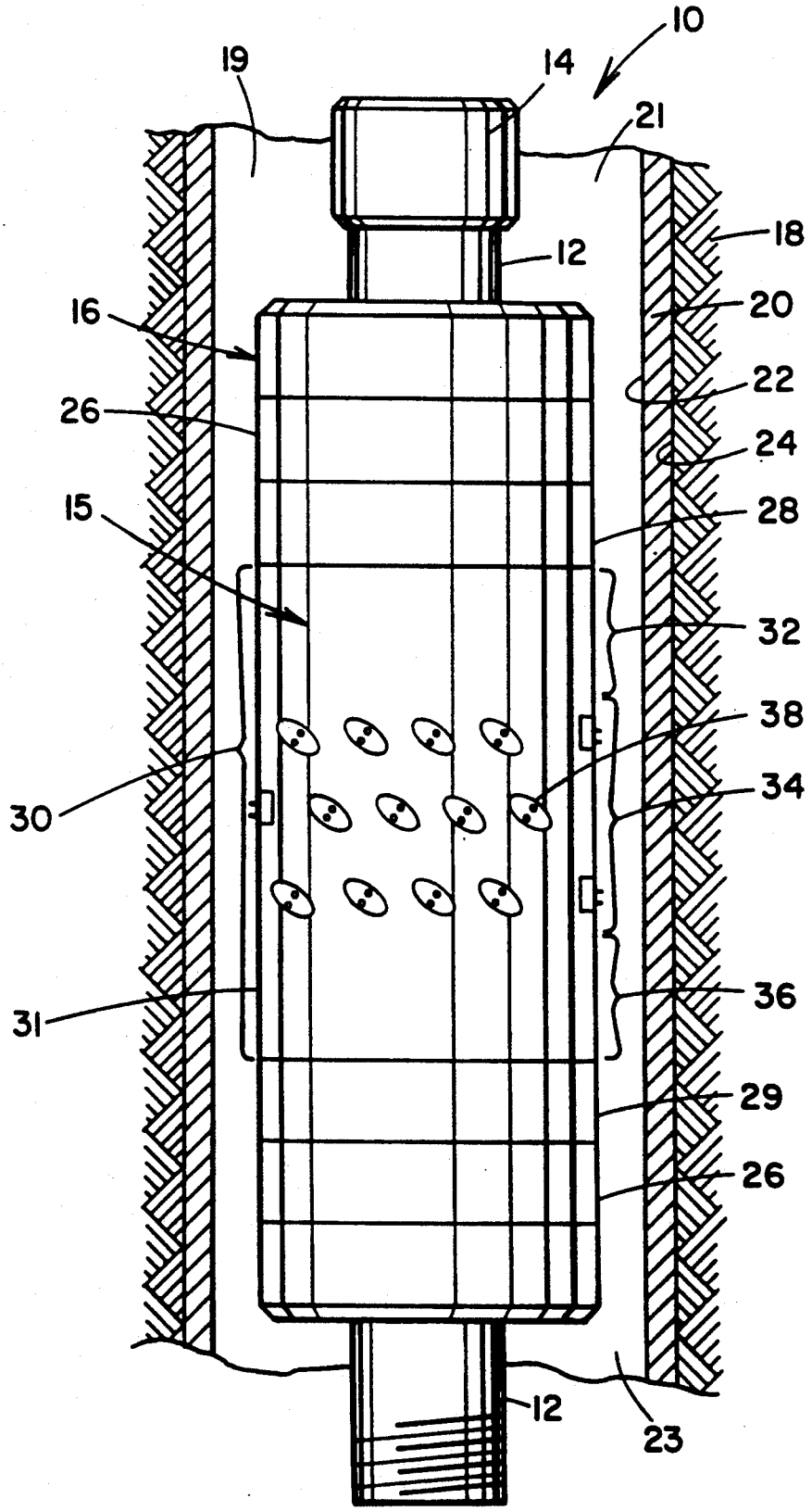
FIG. 1 is a vertical schematic of the gripping inflatable packer of the present invention in its deflated state and lowered into a well bore, with the well bore and an associated metal casing shown in section.
Figure 2:
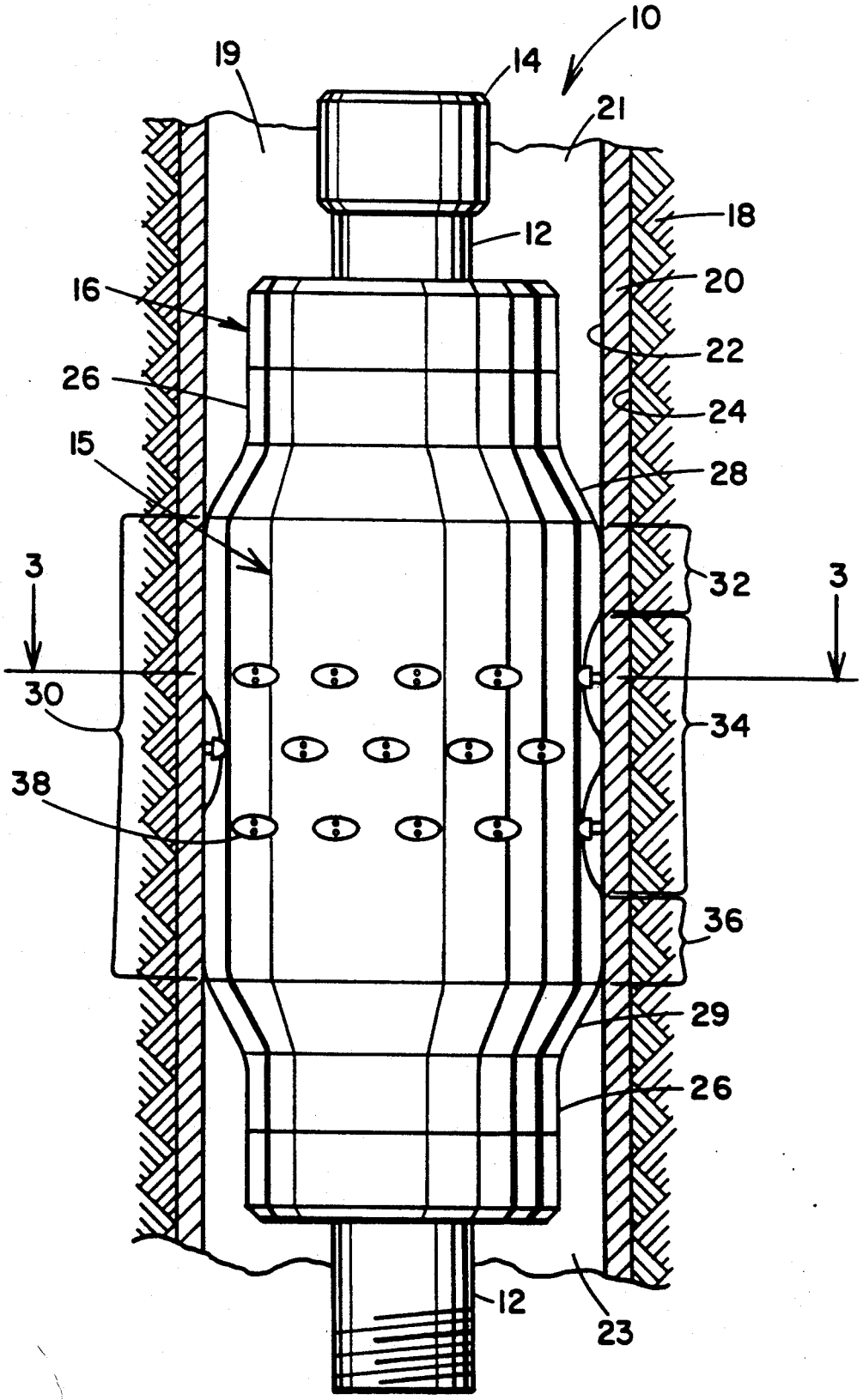
FIG. 2 is a vertical schematic similar to that of FIG. 1, but showing the gripping inflatable packer in its inflated state seated within the well.

Referring to the drawings and particularly to FIGS. 1 and 2, there is shown an inflatable packer assembly 10 including an inner cylindrical mandrel 12 connected to a casing string 14 and an inflatable packer element 16 supported on mandrel 12. The packer element 16 includes an elastomeric bladder 15. The environment in which the packer 10 operates includes a well bore material 18 which may be lined with a casing 20 having a bore 19 and an inner surface 22, also referred to as the well bore wall surface 22. Although this preferred embodiment describes a packer for sealing the annulus 21 in a well lined with a well bore casing 20, it should be understood that the packer 10 can be used alternatively in a well bore without a casing, in which case the well bore inner surface 24 would function as well bore wall surface.

Figure 3:
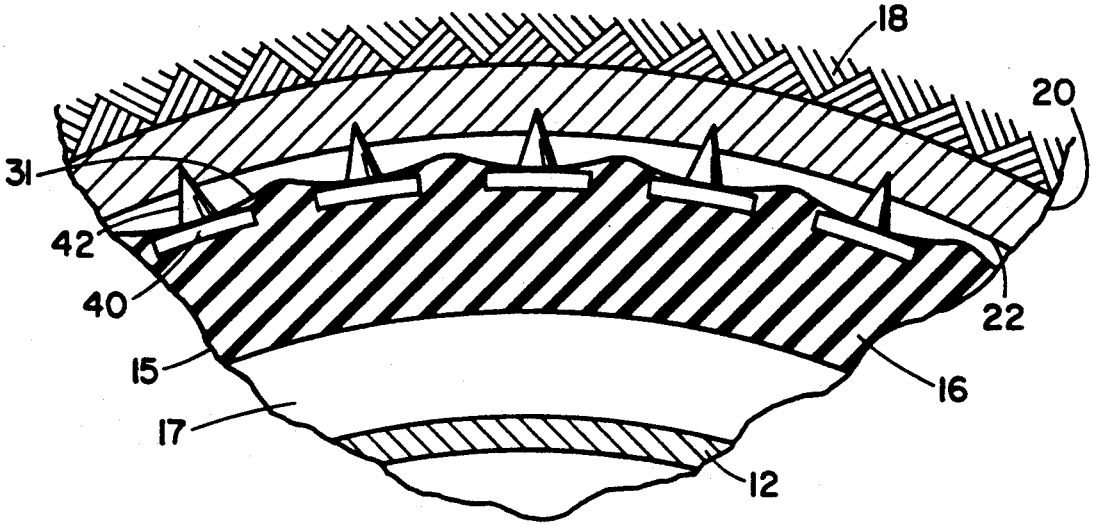
FIG. 3 is an enlarged, partial sectional view taken in part along line 3—3 of FIG. 2 showing the gripper devices and their relationship to the well bore wall.

The packer element 16 preferably includes a reinforced rigid area 26, wherein the working parts related to attachment and inflation of the elastomeric bladder 15 are contained. These components are not critical to the invention and will therefore not be detailed herein. Such details are well known in the art of the inflatable packers, and examples thereof can be found in U.S. Pat. No. 4,614,346, the contents of which are specifically incorporated herein by reference. Referring to FIG. 3, packer element 16 has an open, inflation area 17 which is an annulus where fluid is inserted to cause inflation of the elastomeric bladder 15.

Once again referring to FIGS. 1 and 2, the elastomeric bladder 15 preferably has an upper variable expansion portion 28 and a lower variable expansion portion 29 wherein under inflation the bladder 15 makes the transition from the rigid area 26 to that portion 30 of the elastomeric bladder 15 that makes contact with the well bore wall surface 22 when the bladder 15 is inflated. The bladder 15 preferably has an expansion area 30 having a surface 31 which sealingly engages the well bore wall surface 22 upon inflation of the bladder 15. This expansion area 30 is also referred to as the engageable portion of the elastomeric bladder 15. This expansion area 30 is preferably divided into three portions: a first shoulder portion 32, a middle band portion 34, and a second shoulder portion 36. The middle band portion 34 is that portion of the expansion area 30 where in one preferred embodiment a plurality of gripping elements or grippers 38 are located. The first shoulder portion 32 is that portion extending between the upper variable expansion area 28 and the middle band portion 34 where the sealing engagement of the elastomeric bladder takes place. The second shoulder portion 36, like the first shoulder portion 32, extends from middle band portion 34 to the lower variable expansion portion 29. The middle band portion 34 preferably covers between about 10 to 80 percent of the expansion area 30 and most preferably encompasses about 50 percent of the area 30. The first shoulder portion 32 and second shoulder portion 36 sealingly engage well bore wall surface 22 so as to isolate the annulus 21 in well bore 19 above the packer 10 from the annulus 23 in well bore 19 below the packer 10.

The inflatable packer assembly 10 is lowered to a desired position in a well bore 19, and the elastomeric bladder 15 is then inflated, as shown FIG. 2. When this occurs, first and second shoulder portions 32 and 36, make sealing engagement with the well bore wall surface 22. Moreover, the grippers 38 are pressed against the well bore wall surface 22 by the expansive pressure of the inflation of the elastomeric bladder 15. By having first shoulder portion 32 and second shoulder portion 36 located on either side of the middle band portion 34 where the grippers 38 are contained, the shoulder portions 32 and 36 isolate the middle band portion 34 from the fluid of well bore 19. Without this isolation, well fluid exerts pressure on the surface 31 immediately around grippers 38 and thereby creates a lifting force relative to the wall surface 22. This lifting force tends to counteract the internal expansive pressure that urges the grippers 38 against bore wall surface 22. The isolation of middle portion 34, however, prevents the creation of such a lifting force.

Figure 6:
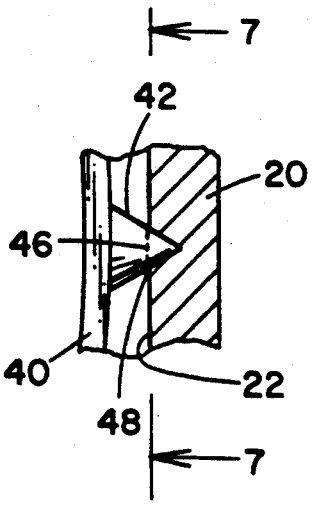
FIG. 6 is an enlarged detail depicting the penetration of the point of the gripper device of FIG. 4 into a well bore wall.

This isolation further eliminates an otherwise continuous lubrication of the contact, illustrated in FIG. 6, of the projecting member 42 with the bore wall surface 22, by the well fluid, which tends to reduce the friction of the contact. The net result of the isolation of middle band portion 34 is to press the grippers 38 with greater force against bore wall surface 22, reduce or eliminate the lubrication of the engaged grippers 38 with the bore wall surface 22, and thereby greatly enhance the frictional force brought about by the engagement of grippers 38 with the surface 22.

Figure 4:
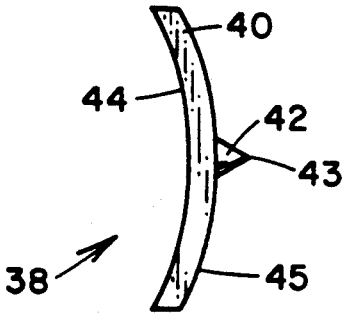
FIG. 4 is an enlarged side view of one embodiment of an individual gripper device constructed in accordance with the present invention.
Figure 5:
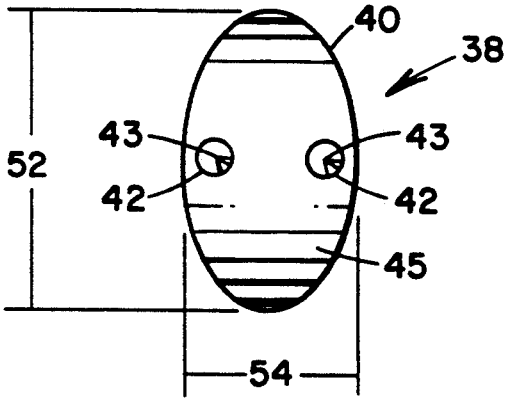
FIG. 5 is a top plan view of the gripper device illustrated in FIG. 4.

Now referring to FIGS. 4 and 5, one preferred embodiment of the gripper 38 includes a base plate 40 and a projecting member 42 having a terminal point 43. More preferably and as illustrated, the gripper 38 includes a pair of projecting members 42. The yield strength of the material of the projecting member 42 is equal to or greater than the yield strength of the material of the well bore wall 22. The plate 40 includes a first or bottom surface 44 and a second or upper surface 45. The base plate 40 of the gripper device has a thickness greater than or equal to about 0.05 inch (1.3 mm) and less than the thickness of the wall of the elastomeric bladder 15. The preferred shape of the projecting member 42 is a cone with a single terminal point 43. However any shape that allows one or more terminal points 43 to protrude from surface 45 is contemplated. Preferably, the material of elastomeric bladder 15 is softened chemically or thermally, and the gripper 38 is then embedded into the bladder 15 to the extent to where the upper surface 45 is substantially flush with the outer surface 31. However, any means of attaching the gripper 38 to the bladder surface 31, such as the use of an adhesive, is contemplated with the present invention. When the elastomeric bladder 15 is inflated, the bottom surface 44 of the gripper 38 is pressed radially outwardly by the elastomeric bladder 15. The amount of total force exerted on the bottom surface 44 is a result of the pressure density along the surface 31 of the elastomeric bladder 15, in pounds per square inch, times the total area of the gripper surface 44. This force is then transmitted via projecting member 42 directly upon and through that projecting member's point 43. Consequently, the point 43 of the projecting member 42 pierces, and embeds itself into, the well bore wall 20.

Figure 7:
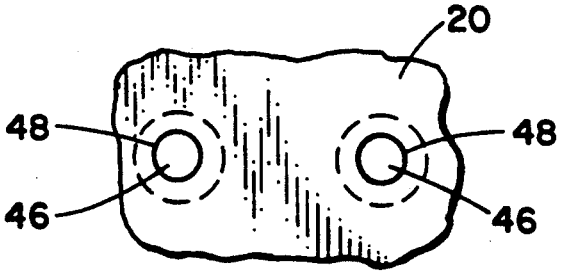
FIG. 7 is a sectional view taken along line 7—7 of FIG. 6.

Now referring to FIGS. 6 and 7, a countervailing surface area 46 is defined by the area within the perimeter edge 48 that would be created if that portion of the projecting member 42 that penetrates the well bore wall 20 were removed. Countervailing surface 46 grows in area as projecting member 42 embeds deeper beyond well bore wall surface 22. The force resisting penetration of the well bore wall 20 by the projecting member 42 equals the surface area of countervailing area 46 times the yield strength of the material of the well bore wall 20. When this force equals the force applied to the bottom surface 44 of the gripper 38, the continued penetration of projecting member 42 into the well bore wall 20 ceases.

The ratio of the surface area of gripper bottom surface 44 to the surface area of the countervailing surface 46 when projecting member 42 has been embedded 0.125 inch (3.2 mm) into well bore wall is defined as the multiplication ratio. It is this multiplication ratio of gripper 38 that causes the pressure that is exerted by the elastomeric bladder 15, when inflated, to be adequate to embed the projecting member tip 43 into the well bore wall 22 to an adequate depth. A depth is considered adequate when it generates sufficient frictional force to effectively resist displacement of the inflatable packer 10, when it is deployed and subjected to differential forces expected to be placed upon it by the well bore environment.

It should be noted that the gripper 38 utilizes point contact with the well bore wall 22, as compared to edge-wise contact, so as to enhance the multiplication ratio. Further, it is believed that the point contact will generate substantially greater frictional force for any given amount of force applied to the bottom surface 44 by the bladder 15. The preferred multiplication ratio is about 65:1 to 15:1, and is determined according to the yield strength of the material of well bore wall 20.

Once again referring to FIGS. 4 and 5, it can be seen that the gripper's bottom surface 44 is preferably curved. Although the bottom surface 44 of the preferred embodiment is curved, with the focus of the curve being directed away from the projecting member 42, other shapes are also contemplated. These shapes include, but are not limited to, curved with the focus toward the projecting member 42, flat, rippled, various compound curves, singularly or multiply pointed, or any surface adaptable for attachment to the elastomeric surface 31. When attached to the elastomeric bladder surface 31, this preferred curvature of the bottom surface 44 conforms to the curvature of the elastomeric bladder surface 31 when the bladder 15 is inflated. The curvature enhances the stability of the grippers when secured to the elastomeric bladder surface 31 while at the same time improving the transference of the pressure from the surface 31 of elastomeric bladder 15 to the bottom surface 44 of gripper 38. As can be seen in FIG. 5, the preferred shape of gripper base plate 40 is generally elliptical, although any annular shape is preferably contemplated. Other contemplated shapes, annular or otherwise, include but are not limited to round, triangular, square, rectangular, or with any number of sides and angles, irregular shapes such as dogbone, and any such shape with perforations. The preferred elliptical form is particularly conducive to increasing the effective surface area of the bottom surface 44 and thus increasing the penetration portion of the projecting member 42. The base plate 40 preferably has a longest dimension 52 and a shortest dimension 54, with the ratio of the longest dimension 52 to the shortest dimension 54 being defined as the aspect ratio of the plate 40. The preferred aspect ratio of the plate 40 is within the range of about 1:1 to 5:1.

Figure 8:
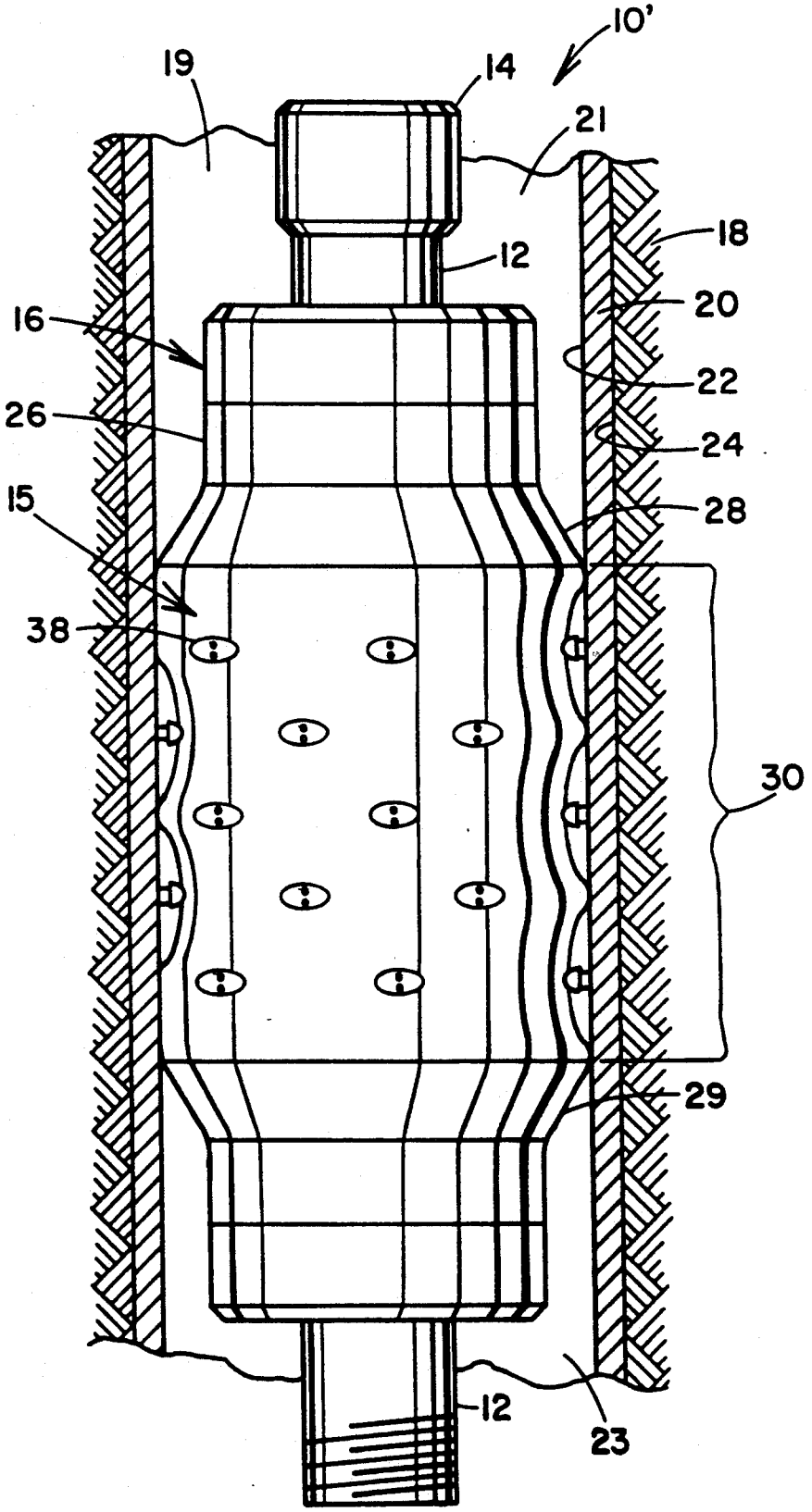
FIG. 8 is a schematic view similar to that of FIG. 2, but illustrating an alternate embodiment of the packer wherein the gripper devices are distributed throughout the entire outer surface of the expandable elastomeric bladder.

An alternate embodiment of the invention is shown in conjunction with packer assembly 10' of FIG. 8. This embodiment is essentially the same as the prior embodiment illustrated in FIGS. 1 and 2 described above, with the exception that the grippers 38 are distributed throughout entire expansion area 30 without regard for first shoulder portion 32, second shoulder portion 36, or middle portion 34. In this embodiment, however, the grippers 38 are necessarily spaced far enough apart from each other so as to allow for sealing engagement of the surface 31 between grippers 38 with the well bore wall surface 22. As can be seen in FIG. 3, the presence of grippers 38 tend to interfere with the surface 31 engaging the well bore wall surface 22 in between the grippers 38, as the force at the gripper bottom surface 44 pushes the elastomeric bladder surface 31 away from well bore wall surface 22. However, if the grippers 38 are spaced far enough apart, as in this FIG. 8 embodiment, a sufficient amount of the overall elastomeric bladder surface 31 engages the well bore wall surface 22 so as to effect a seal isolating the annulus 21 of well bore 19 from the annulus 23.

Figure 9:
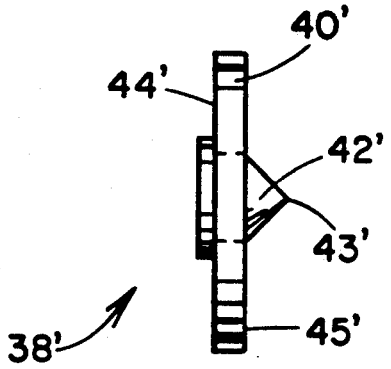
FIG. 9 is a side view similar to that of FIG. 4, but illustrating an alternative embodiment of a gripper device.
Figure 10:
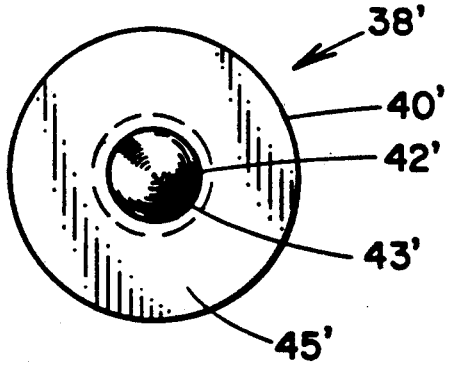
FIG. 10 is a top plan view of the embodiment of FIG. 9.

Another alternate embodiment for the gripper construction and which is applicable to either packer embodiment 10 or 10' as previously described includes grippers 38' as illustrated in FIGS. 9 and 10. The differences between the gripper 38 of FIGS. 4 and 5 and gripper 38' as depicted in FIGS. 9 and 10, include the base plate 40' being round as opposed to being generally elliptical, with the bottom surface 44' being preferably flat as opposed to curved. Moreover, there is a single projecting member 42' in this alternate gripper embodiment. The projecting member 42' is preferably cone shaped with a single terminal point 43'. However, any shape that allows one or more terminal points 43' to protrude from the surface 45' is contemplated.

By providing grippers 38 distributed on outer surface 31 and with a geometry that utilizes the pressure along bladder surface 31 to create a pressure density conducive to embedding the projecting member 42 into well bore wall 22, a gripping inflatable packer is described and illustrated that will not be undesirably displaced axially when deployed in a well bore.

The foregoing description and the illustrative embodiments of the present invention have been shown in the drawings and described in detail in varying modifications and alternate embodiments. It should be understood, however, that the foregoing description of the invention is exemplary only, and that the scope of the invention is to be limited only to the claims as interpreted in view of the prior art. Moreover, the invention illustratively disclosed herein suitably may be practiced in the absence of any element which is not specifically disclosed herein.

What is claimed is:

1. A gripper device for attachment to the elastomeric bladder of an inflatable packer to sealingly engage the inner surface of a well bore wall upon expansion of said packer, said gripper device comprising:

a base plate having first and second surfaces disposed on opposite sides of said plate, said base plate being generally elliptical having an aspect ratio within the range of about 1:1 to 5:1 and adapted to be embedded in said elastomeric bladder with said first surface substantially conforming to and flush with the outer surface of said elastomeric bladder;

at least one projecting member terminating in a point protruding from said first surface; and said device includes a ratio of the total area of said second surface to the area defined by an annular edge created by removing about the top 3.2 mm of said projecting member, nearest the tip of said projecting member, and wherein said ratio ranges from about 65:1 to 15:1.

2. The gripper device of claim 1 wherein the ratio of the longest dimension of said elliptical plate to the length of said projection member is in the range of about 20:1 to 2:1.

3. The gripper device of claim 1 wherein said second surface is curved, with the focus of said curve being in a direction opposite that of said point.

4. A gripping inflatable packer having an elastomeric bladder expandable to sealingly engage the outer surface thereof against the wall surface of a well bore to effectively inhibit the passage of well fluid through said well bore, said gripping inflatable packer comprising:

a mandrel adapted to connect to a well string;

an elastomeric bladder, about said mandrel, having an outer surface sized and shaped to provide a portion that is engageable with said well bore wall surface upon expansion thereof, said engageable surface portion having a middle band portion extending cylindrically around said outer surface, and first and second shoulder portions disposed on either side of said middle band portion, each said shoulder portion extending cylindrically around said outer surface; and means for gripping the wall surface of said well bore upon expansion of said bladder distributed about said middle band portion only, said gripping means including at least one gripper device attached to the outer surface of said elastomeric bladder, said gripper device having:

a base plate having first and second surfaces disposed on opposite sides of said plate; and at least one projecting member means terminating in a point protruding from said first surface for engagement with said wall surface upon inflation of said packer.

5. The gripping inflatable packer device of claim 4, wherein said middle band portion comprises between about 10 percent to about 80 percent of said engageable surface portion.

6. The gripping inflatable packer device of claim 4, wherein said point of said gripper device is unitary.

7. The gripping inflatable packer device of claim 4, wherein said gripper device includes a plurality of said points.

* * * * *